US007845588B1

(12) United States Patent
Goodick

(10) Patent No.: US 7,845,588 B1
(45) Date of Patent: Dec. 7, 2010

(54) PORTABLE TOOL UTILIZING COMPOUND LEVERAGED ACTUATION TO REDUCE MEDICINE SOLIDS

(76) Inventor: Mark Trevis Goodick, 2875 Vallecito Pl., Oakland, CA (US) 94606

( * ) Notice: Subject to any disclaimer, the term of this patent is extended or adjusted under 35 U.S.C. 154(b) by 0 days.

(21) Appl. No.: 12/768,224

(22) Filed: Apr. 27, 2010

Related U.S. Application Data

(60) Provisional application No. 61/309,436, filed on Mar. 2, 2010.

(51) Int. Cl.
*B02C 19/00* (2006.01)

(52) U.S. Cl. ..... 241/169; 241/169.2; 241/DIG. 27

(58) Field of Classification Search ..... 241/169, 241/169.2, DIG. 27, DIG. 17, 264, 266
See application file for complete search history.

(56) References Cited

U.S. PATENT DOCUMENTS 2,631,786 A * 3/1953 Morgan et al. ..... 241/169
3,915,393 A * 10/1975 Elkins ..... 241/168
4,003,523 A * 1/1977 Doolittle ..... 241/169.2
D285,966 S 9/1986 Porter
5,123,601 A 6/1992 Lavin et al.
5,178,337 A 1/1993 Lupoli
5,863,001 A 1/1999 Schulze
5,924,636 A * 7/1999 Calderon ..... 241/84.3
6,637,683 B1 * 10/2003 (Lomax) Wilbur ..... 241/101.2
6,966,509 B2 * 11/2005 Janzen ..... 241/169
7,252,254 B1 8/2007 Engel et al.
7,444,851 B1 11/2008 Janson
7,445,172 B1 11/2008 Bucknor

* cited by examiner

*Primary Examiner*—Faye Francis
(74) *Attorney, Agent, or Firm*—Patent Prep and Pros Group, LLC

(57) ABSTRACT

A portable tool for effectively reducing medicine solids during compound leveraged actuation. The portable tool may include a first handle adapted to receive a downward force during actuation, a second handle adapted to receive an upward force during actuation, a first reducing jaw pivotally connected to the first handle and a second reducing jaw, and a second reducing jaw pivotally connected to the second handle and the first reducing jaw. The first reducing jaw and the second reducing jaw may be adapted to receive a medicine solid therebetween in an open-jaw position. Then, in response to applying a force to one or both of the first and second handle(s), a leveraged actuation simultaneously causes the first reducing jaw to pivot with the first handle and the second reducing jaw to pivot with the second handle, such that the received medicine solid is reduced between the first and second reducing jaws as the portable tool achieves a closed-jaw position.

6 Claims, 7 Drawing Sheets

PORTABLE TOOL UTILIZING COMPOUND LEVERAGED ACTUATION TO REDUCE MEDICINE SOLIDS

CROSS REFERENCE TO RELATED APPLICATIONS

The present application claims the benefit of U.S. Provisional Application No. 61/309,436, filed Mar. 2, 2010, fully incorporated herein by reference.

FIELD OF THE INVENTION

The field of the present invention generally relates to pill crushing devices that allow a medical professional or a self-administering patient to reduce a dosed medicine solid into a pulverized form. The medical professional or patient may then elect to mix the pulverized medicine with a food solid or dissolve the pulverized medicine as a solute in a liquid solvent for intraoral administration through a feeding tube.

BACKGROUND OF THE INVENTION

To date, the most effective and the least expensive mechanism of manufacturing and dosing medications is in solid pill form. As is commonly understood by those skilled in the art, pills generally refer to pharmacological oral dosages of active ingredient(s) in solid form. In popular culture, the term "pill" is often used to refer to: tablets, capsules, and caplets. Unfortunately, there are several potential problems associated with administering this medium of medication. The problems associated with administering pills in whole/solid form include Patients having impaired swallowing ability secondary to various medical conditions, swallowing disorders associated with aging, altered mental status, altered level of consciousness, and/or general difficulty or aversion to swallowing pills whole. To accommodate the special needs of patients with these problems, medicine solids are typically transformed into a fine powder that can be mixed with food solids or dissolved in a liquid, which can then be optimally administered to the Patient either orally or through a feeding tube.

To achieve this physical state transformation, several different types of pill crushing and grinding devices have been created, which are each capable of reducing medicine solids into powdered form. A few common pill crusher and grinder device types include: tabletop crushers, handheld grinders, and handheld crushers. As would be appreciated by those skilled in the art (e.g., health care professionals who routinely administer dosed medicine solids in reduced form), the tabletop variety of medicine crushers, although often very efficient at pulverizing medicines to a fine powder, are typically: bulky, overbuilt, not easily transportable, noisy in operation, and expensive (See e.g., U.S. Pat. Nos. 7,364,102, Engel et al.; 7,427,041, Hall et al.; 6,059,209, Barson; and 7,300,006, Weisbeck). In contrast, most modern handheld pill crushers and grinders are often very inefficient due to the fact that they are underbuilt and poorly designed to achieve similar results as their tabletop counterparts.

Handheld pill grinders on the market today generally provide poor rotational mechanical advantage (See e.g., U.S. Pat. No. 5,148,995, Hurst). These devices may require a significant amount of hand strength and time to properly reduce a pill into a useable form. Further, all pill grinders require the medication being ground to come in direct physical contact with the grinding mechanism, (e.g., grinding faces, blades, or serrated edges), and are difficult to thoroughly and effectively cleanse between uses. As such, pill grinders are very prone to cross contamination and are generally not preferred for use in medical service facilities such as hospitals, clinics, and nursing homes. Given that some people in society have potentially lethal medication allergies, these types of devices are best restricted to use in the home and by a sole individual, in the interest of patient safety.

Handheld pill crushers on the market today can provide for contamination prevention by utilizing plastic pouches or fitted pairs of paper cups that a medicine solid may be respectively placed inside, or between, before being crushed or pulverized (See e.g., U.S. Pat. Nos. 5,123,601, Lavin; and 5,863,001, Schulze). Unfortunately, these devices provide insufficient mechanical advantage to effectively reduce a medicine solid to a soluble form required for effective, reliable feeding tube administration. Modern handheld crushers also require a significant amount of hand strength to operate (e.g., due to single pivot point actuation), particularly for dense, coated medicine solids.

As would be understood by those skilled in the art, plastic tubing used for administering reduced medications in liquid form can easily become clogged with deposits or buildups of reduced medication particles which are too large to properly dissolve in a liquid solvent. Further, medical practitioners (e.g., physicians and registered nurses) come in all shapes, ages, and sizes. This can result in largely varying hand strength amongst different medical practitioners who may be responsible for crushing a dosed medicine with a pill crusher type hand tool. Accordingly, in some scenarios, a hand tool that may work effectively enough for one medical practitioner (e.g., a practitioner with substantial hand strength) may not work at all for another medical practitioner (e.g., a practitioner with deficient hand strength), if that individual is incapable of providing the requisite mechanical force to a handheld crusher to allow it to effectively crush a particular medication solid.

Accordingly, it would be beneficial to have an improved handheld pill crusher device that was designed with sufficient mechanical advantage, such that it was capable of easily crushing any medicine solid in response to minimal applied force. It would also be advantageous to have a device that were ergonomically adapted to fit the hand of any medical practitioner and that facilitated powerful pill crushing actuation relative to an applied force. It would be helpful if this handheld crusher device were designed to be used in combination with disposable medicine retainers, such as plastic pouches and sleeves, in order to prevent the possibility of medication contamination. It would also be beneficial if this device were truly portable, such that it could be readily used at any medication administration location by any health care provider or self-administering patient. More particularly, it would be beneficial to be able to use the device at a patient's bedside (in keeping with nursing theory and practice) to administer medications in the safest possible manner, thereby reducing the possibility/potential for medication administration errors. Further, it would be advantageous if an improved handheld pill crusher were quiet in operation (so as not to disturb a sleeping patient) and if it also included an effective pill splitter component that allowed a medical practitioner to split a pill to a preferred dose before crushing it. This could further enhance the effectiveness of the device by adding to its capabilities, thereby making it a multi-function hand tool.

SUMMARY OF THE INVENTION

This summary is provided to introduce (in a simplified form) a selection of concepts that are further described below in the Detailed Description. This summary is not intended to identify key features of the claimed subject matter, nor is it intended to be used as an aid in determining the scope of the claimed subject matter.

In overcoming the above disadvantages associated with modern pill crusher devices, the present invention discloses a portable tool for reducing medicine solids utilizing leveraged actuation. The portable tool may be configured to include a first handle adapted to receive a downward force during actuation, a second handle adapted to receive an upward force during actuation, a first reducing jaw pivotally connected to the first handle, and a second reducing jaw pivotally connected to the second handle. The first reducing jaw and the second reducing jaw may be adapted to receive a medicine solid therebetween in an open-jaw position.

In response to at least one applied force, a leveraged actuation may simultaneously cause the first reducing jaw to pivot with the first handle and the second reducing jaw to pivot with the second handle, such that the medicine solid is effectively reduced between the first and second reducing jaws as the portable tool achieves a closed-jaw position.

In accordance with another aspect of the present invention, the portable tool may reduce the medicine solid into a fine powder in response to one or more leveraged actuations of the tool.

In accordance with a further aspect of the present invention, the first handle and the second handle may be pivotally connected, and in response to the applied force, the leveraged actuation further causes a portion of the first handle to pivot with a portion of the second handle.

In accordance with another aspect of the invention the first reducing jaw and the second reducing jaw may be pivotally connected, and in response to the applied force, the leveraged actuation may further causes a portion of the first reducing jaw to pivot with a portion of the second reducing jaw.

In accordance with yet another aspect of the present invention, the second handle may include a medicine solid splitting mechanism configured at a distal end of the second handle.

In accordance with yet a further aspect of the present invention, the first handle may include a locking mechanism that allows the first handle to be locked to the second handle when the hand tool is in the closed-jaw position.

In accordance with another aspect of the present invention, the second handle may include a stand portion that allows the portable tool to remain in an upright position utilizing the second handle as a base.

BRIEF DESCRIPTION OF THE DRAWINGS

Preferred and alternative examples of the present invention are described in detail below with reference to the following Figure drawings.

DETAILED DESCRIPTION

Figure 1:
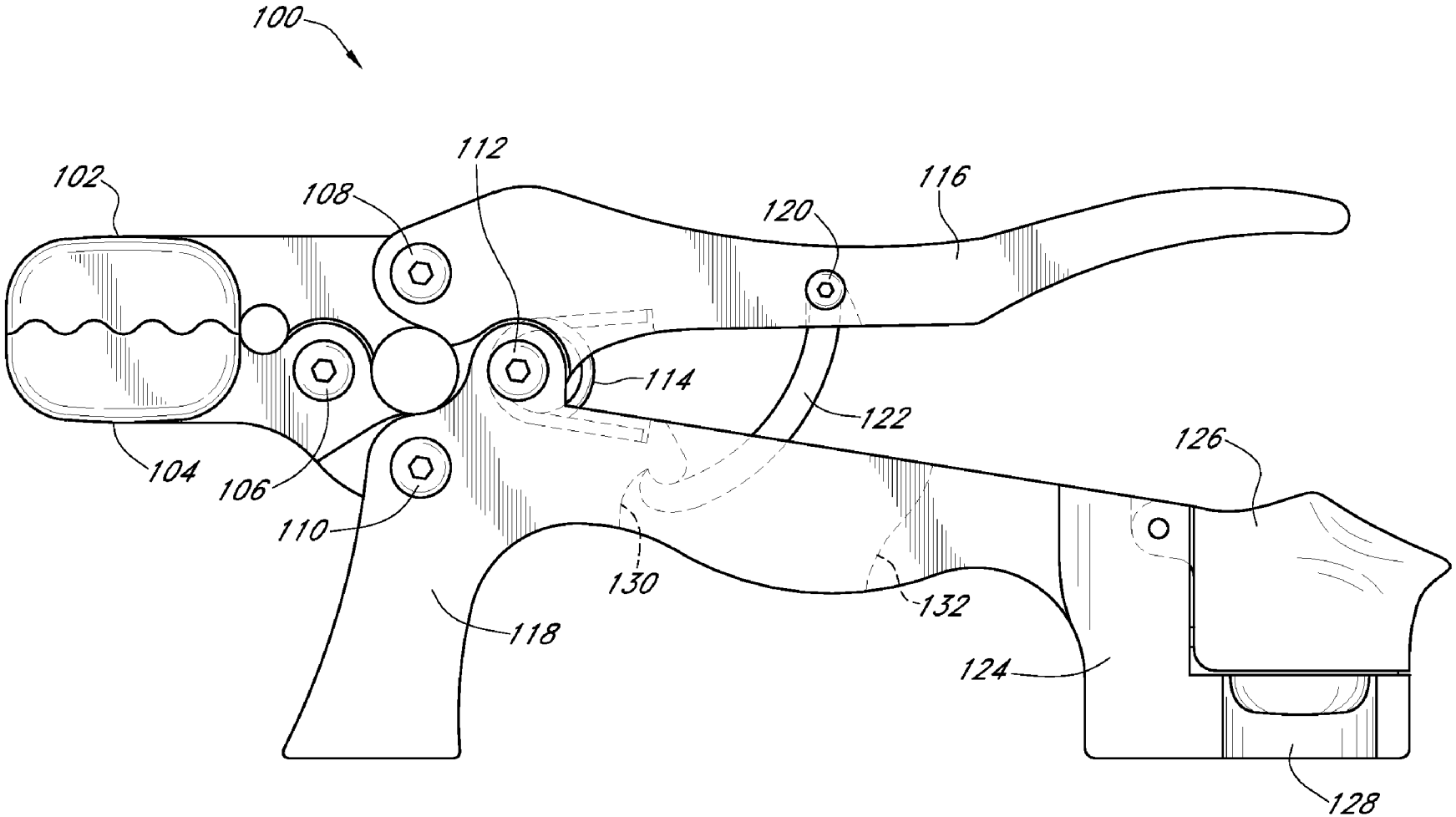
FIG. 1 illustrates a side plan view of a pill crushing device in a closed-jaw, locked position, in accordance with an embodiment of the present invention.

In accordance with an exemplary embodiment of the present invention, FIG. 1 illustrates a portable pill crushing device 100 configured to operate with compound leveraged actuation, in response to external, applied force. The pill crushing device 100 is a hand-held tool that is well-suited for use at any common location where medical care can be administered, such as at a patient's bedside. A responsible physician or a registered nurse may utilize the pill crushing device 100 to prepare a medicine solid (e.g., by reducing the solid into a powdered form), generally comprising a pharmacological dosage of one or more prescribed active ingredient (s), for administration to their assigned patient. This medical caregiving may include intra-oral administration of a medication solution via a feeding tube, or it may include mixing a reduced medicine with a food solid or liquid nutritional supplement for traditional oral intake and ingestion.

Figure 2:
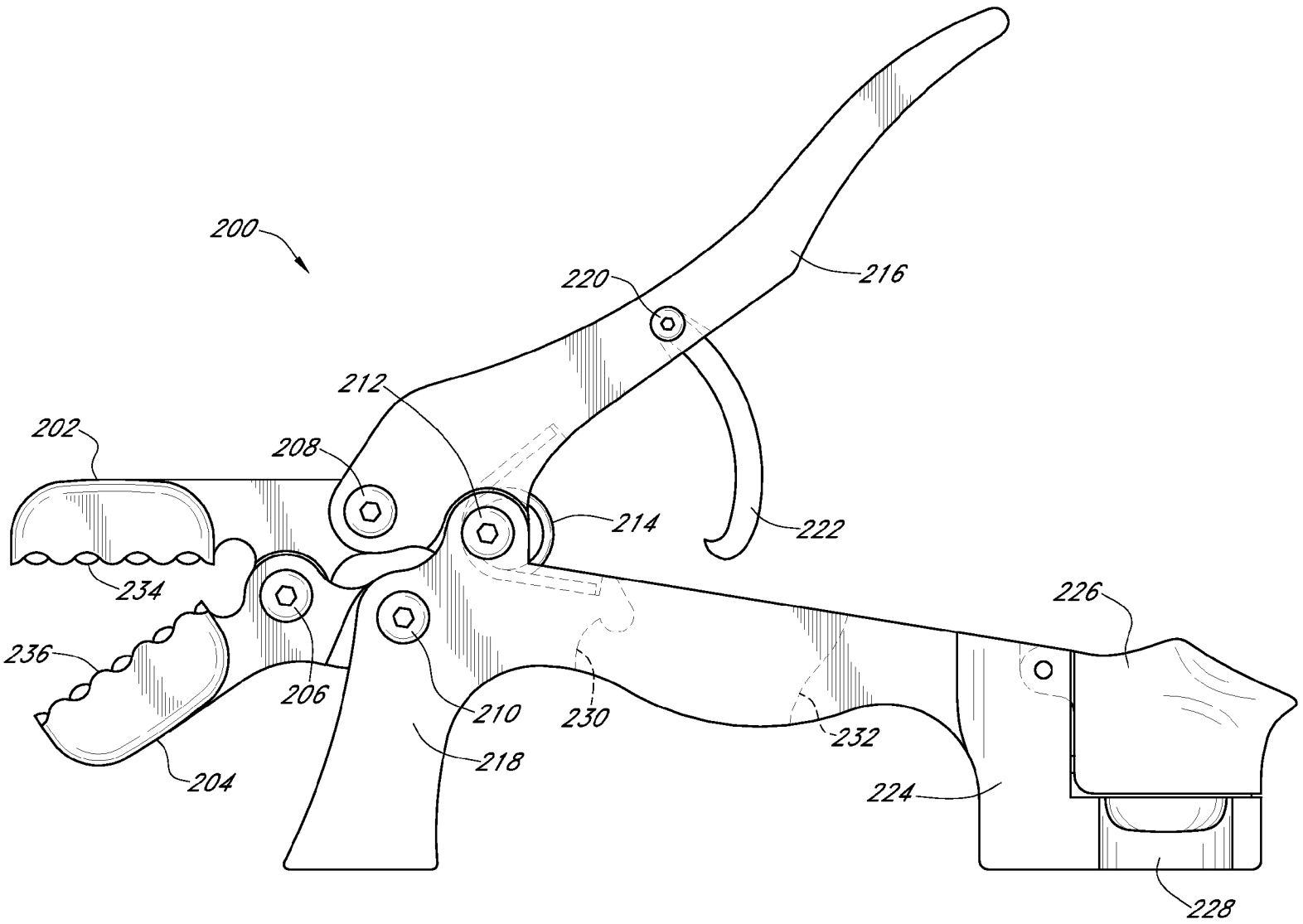
FIG. 2 illustrates a side plan view of a pill crushing device in an open-jaw, unlocked position, in accordance with an embodiment of the present invention.
Figure 3:
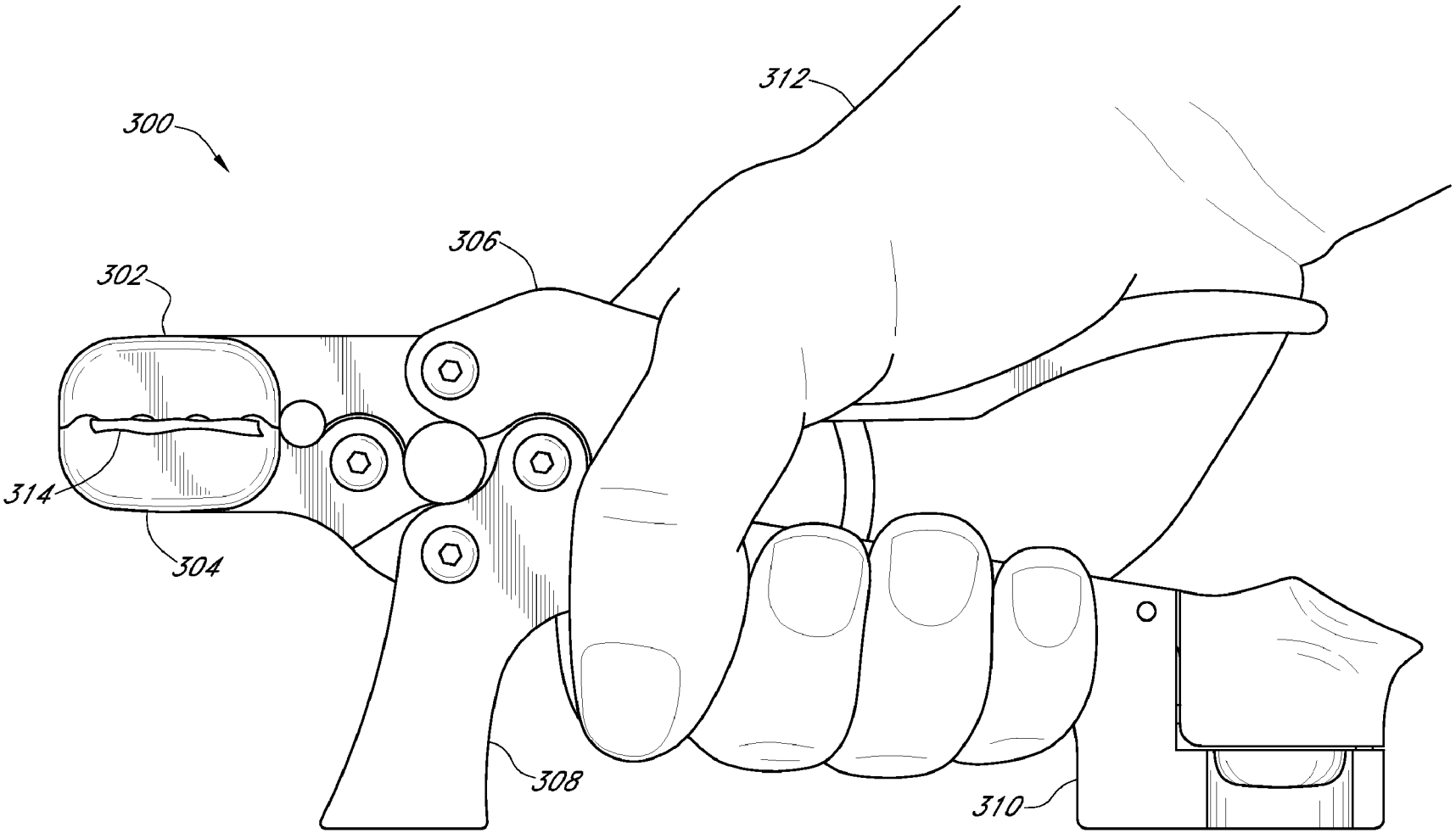
FIG. 3 illustrates a side view of a pill crushing device being used to crush a medicine solid that is contained within a durable sleeve, in accordance with an embodiment of the present invention.
Figure 7:
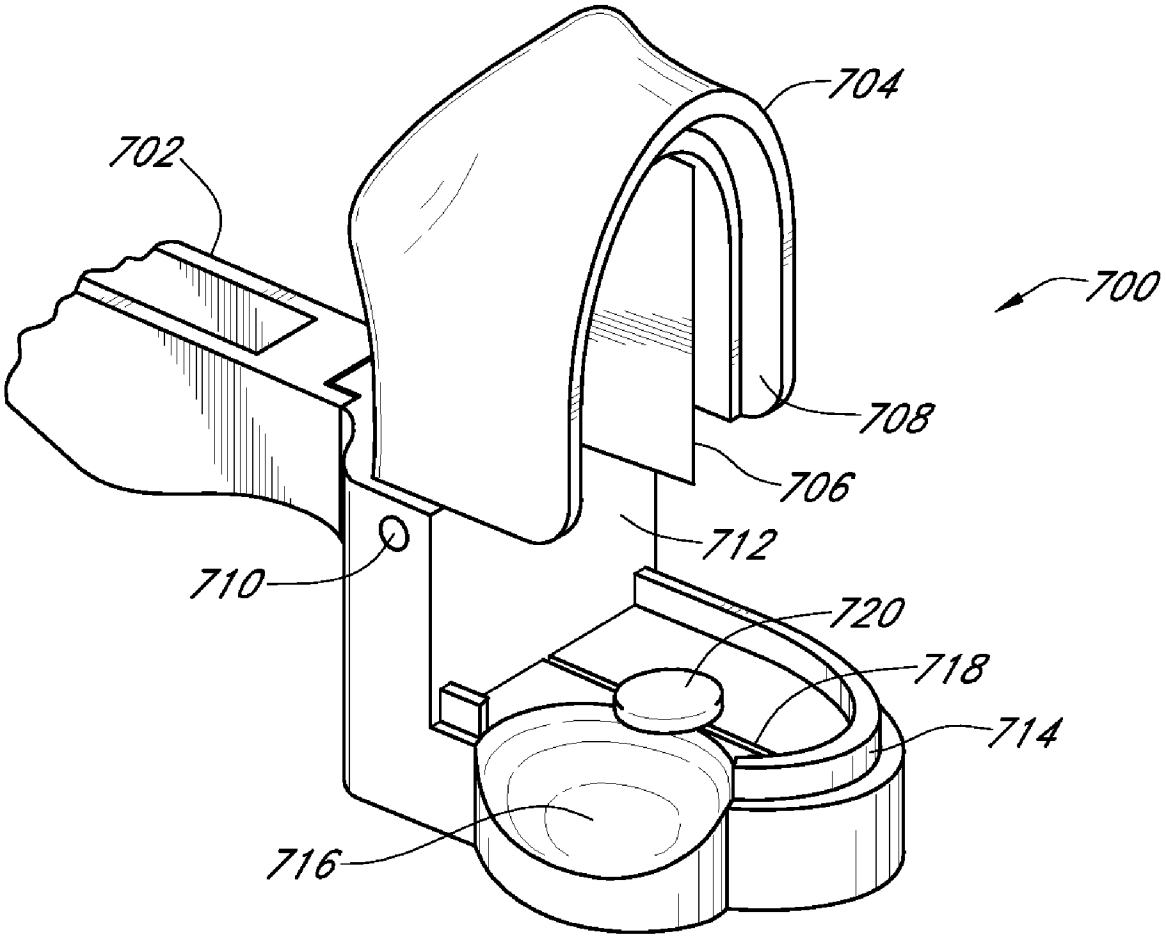
FIG. 7 illustrates a sectional, perspective view of a medicine solid splitting component of a pill crushing device in an open position having a medicine solid positioned therein, awaiting partitioning.

In an embodiment, the pill crushing device 100 includes at least the following components: a first handle 116 (a contoured handle) that is optimally adapted in shape and dimensions to receive a downward applied force from a person's hand during actuation of the device 100 (e.g., a downward force applied by the palm of a hand, as depicted in FIG. 3); a second handle 118 that is optimally adapted in shape and dimension to receive an upward applied force from a person's hand during actuation of the device 100 (e.g., an upward force applied by the digits of a hand in a gripping action, as depicted in FIG. 3, or optionally as a secondary force applied in response to the base 118 of the device 100 being pressed against a tabletop or any other rigid surface; a first reducing jaw 102 that is configured with a shallow eggcrate-patterned surface (e.g., further depicted in FIG. 2); a second reducing jaw 104 that is also configured with a mirrored, shallow eggcrate-patterned surface (e.g., further depicted in FIGS. 2 and 5); a forward compound pivot component 106 that pivotally connects the first reducing jaw 102 with the second reducing jaw 104; a rearward compound pivot component 112 that pivotally connects the first handle 116 with the second handle 118 and acts as a support shaft for a coil spring component 114; an upper compound pivot component 108 that pivotally connects the first reducing jaw 102 with the first handle 116; a lower compound pivot component 110 that pivotally connects the second reducing jaw 104 with the second handle 118; a swing arm locking component 122 that is pivotally connected with the first handle 116 at an intermediate (central) location between the distal ends of the first handle 116, at a swing arm pivot point 120; and a medicine solid splitting component having an upper portion 126 that can be gripped (e.g., with a thumb and a forefinger or index finger) and opened (as depicted in FIG. 7) to facilitate a pill splitting action, and a lower portion 124 having a contoured receptacle 128 adapted to receive a portion of a split pill after a pill splitting action has taken place and the medicine solid splitting component is in a closed position.

In an embodiment, when a user is not using the pill crusher device 100 to crush or split a medicine solid, a user may depress the first handle 116 of the device 100 (thereby creating a spring 114 tension between the first and second handles 116 and 118) and simultaneously tilt the pill crusher device 100 at a slight downward angle in a closed-jaw position (where the first 102 and the second 104 reducing jaws are flush and fitted with each other, and in a lowered position relative to the distal non-pivotally connected ends of the first and second handles 116 and 118). By these simultaneous compression and tilting actions, the swing arm locking component 122 may swing forward, initially directed by guide recess 132 until a hook at the locking component's 122 distal end catches on an internal latch recess 130 of the second handle 118. Once in a closed-jaw, locked position, the device 100 can be safely, and compactly stored when not in use. To release the swing arm locking component 122 from the latch recess 130, thereby unlocking the pill crusher device 100, all that is required is a single downward depression force applied to the first handle 116. In response to this unlocking force, the hook component at the distal end of the locking component 122 may be released from the internal latch recess 130 of the second handle 118, such that it can swing freely, as the tension force of the coil spring 114 on the first and the second handles 116 and 118 causes the device 100 to achieve an open-jaw position (as depicted in FIG. 2).

The second handle 118 of the pill crusher device 100 may be further adapted to include a stand component that includes a forward base leg as part of the second handle 118 and a rearward base leg that includes the second portion 124 of the medicine solid splitting component. The stand 118, 124 of the pill crusher device 100 may allow the device to stand in an upright position when unattended, so that the usable components (e.g., the areas of the first 102 and second 104 reducing jaws adapted to crush a medicine solid, the areas of the first 116 and second 118 handles designated for gripping, and the upper portion 126 of the pill splitting component designated for gripping) of the pill crusher device 100 will not come in contact with any foreign contaminants, as could happen if the device 100 were laying on its side on a medical cart or table that could comprise any number of biological or chemical contaminants. Additionally, the stand 118, 124 of the pill crusher device 100 may act as a secure mechanism for allowing a physician or a registered nurse to apply a significant force to the pill crusher device 100 by bearing down on the first handle 116 with their body-weight, while the pill crusher device 100 is standing securely on a table or another rigid surface.

In an embodiment, the pill crusher device 100 may be adapted to be used with a plastic medicine pouch or sleeve (See e.g., U.S. Pat. No. 7,637,449, Leyshon et al.) that is constructed with a requisite durability to prevent the egg-crate-patterned surfaces on the faces of the first 102 and second 104 reducing jaws (which are mirrored with each other to allow the patterned surfaces to fit flush with one another in a closed-jaw position) from puncturing, ripping, or tearing the pouch while a medicine solid is being crushed within it (as depicted in 314 of FIG. 3). The eggcrate-patterned surfaces on the faces of the first 102 and second 104 reducing jaws are specifically designed to initially break and then spread a crushed medicine solid in such a way as to maximize powderization of a crushed pill with a limited number of actuations of the pill crusher device 100.

In an embodiment the first handle 116 may further comprise an internal recess that only facilitates the swing arm locking component 122 connected to the first handle 116 at the swing arm pivot point 120, to swing with an angle of rotation that is physically limited to no more than 45 degrees, in order to facilitate secure, reliable latching and unlatching (e.g., locking or unlocking) of the swing arm locking component 122 from the internal latch recess 130 of the second handle 118. The swing arm locking component 122 may be secured with the internal latch recess 130 of the second handle 118, while the coil spring 114 applies adequate spring force (e.g., in accordance with Hooke's Law of spring elasticity) to prevent the swing arm locking component 122, once set, from freely unlatching without the application of a deliberate downward unlocking force applied by a user of the pill crushing device 100. In this way, the pill crushing device 100 advantageously includes a simple mechanical counterforce (by use of the coil spring 114) to an applied external force, which acts to automatically return the pill crushing device to an open-jaw position (See e.g., the position of the pill crusher device 200 in FIG. 2) and to secure the pill crusher device 100 in a locked closed-jaw position (See e.g., the position of the pill crusher device 100 in FIG. 1), when not in use. In alternate embodiments, the spring may be replaced by strong, compact magnets, having like-poles facing each other, to offer a substantial repulsive magnetic force, by other spring-type mechanisms, or by any other common means for providing a repulsive force, offering the same basic advantages associated with the coil spring 114, without departing from the spirit and scope of the present invention.

FIG. 2 illustrates a pill crushing device 200 in an open-jaw, unlocked position, in accordance with an embodiment of the present invention. It should be noted that the pill crushing devices 100 and 200, respectively depicted in FIG. 1 and FIG. 2, are the same device depicted in different functional positions (and open-jaw position 100 and a closed-jaw position 200). Accordingly, the 100-series reference numbers of FIG. 1 correspond with the 200-series reference numbers of FIG. 2 (e.g., components 102, 104, 106, 108, 110, 112, 114, 116, 118, 120, 122, 124, 126, 128, 130 and 132 of FIG. 1 respectively correspond to components 202, 204, 206, 208, 210, 212, 214, 216, 218, 220, 222, 224, 226, 228, 230 and 232 of FIG. 2). The pill crushing device 200 in the open-jaw position depicts the swing arm locking component 222 hanging freely with a small internal recess of the first handle 216, such that the swing arm 222 will not inadvertently flip around or otherwise interfere with the function of the pill crushing device during use. In the open-jaw position, the first and second reducing jaws 202 and 204 of the pill crushing device 200 are shown to have offset, shallow, egg-crate patterned (bumpled) surfaces 234 and 236 that respectively fit with each other as mirrored physical surfaces when the device 200 achieves a closed-jaw position.

In the open-jaw position 200, the forward compound pivot component 206 (P1) that pivotally connects the first reducing jaw 202 with the second reducing jaw 204, the rearward compound pivot component 212 (P4) that pivotally connects the first handle 216 with the second handle 218, the upper compound pivot component 208 (P3) that pivotally connects the first reducing jaw 202 with the first handle 216, and the lower compound pivot component 210 (P2) that pivotally connects the second reducing jaw 204 with the second handle 118, collectively function to facilitate a compound leveraged actuation that transitions the pill crusher device 200 from an open-jaw state 200 to a closed-jaw state 100 in response to external, applied force (e.g., in response to the gripping action of a person's hand as depicted in FIG. 3). As would be understood by those skilled in the art, the first handle 216 and the second handle 218 act as lever arms and there are two sets of mechanical levers as part of the pill crusher device 200 that facilitate a compound leveraged actuation that has a significant mechanical advantage to single pivot-point handheld pill crushers presently on the market (See e.g., U.S. Pat. No. 5,123,601, Lavin). The mechanical advantage of the compound-leveraged pill crusher 200 may be described by the following formula (where the length between the distal end of either of the first 202 and second 204 reducing jaws and P1 is represented by reference number L1; the length between P1 and either P2 or P3 is represented by reference number L2; the length between either of P2 or P3 and P4 is represented by reference number L3; and the length between either P2 or P3 and the distal end of either of the first and second handles 216 and 218 is represented by reference number L4:

$$\text{Mechanical Advantage}=(L2/L1)\times(L4/L3)$$

As would be understood by those familiar with the benefits of compound leveraging in hand tools, the mechanical advantage (e.g., a generated crushing force) associated with the above described formula could produce a 10-to-1, 15-to-1, or a 20-to-1 mechanical advantage benefit in favor of the compound leveraged handheld pill crusher device 200, compared to those of the prior art (e.g., single pivot point pill crushers, such as U.S. Pat. No. 5,123,601, Lavin). The actual mechanical advantage would depend on the selected lengths of the lever arms 216 and 218 (L4), the reducing jaws 202 and 204 (L1), and the lengths between the pivot components 206, 208, 210, and 212 (L2 and L3) relative to each other. This significant mechanical advantage is very useful for implementation in a crusher-type hand tool, where a reducing/crushing surface area (the eggcrate-patterned crushing surfaces 234 and 236) of the device 200 can be maximized by distributing a mechanically converted force across a relatively small surface area, ranging between the surface area sizes associated with the faces of a US quarter coin and a US half-dollar coin. It should be understood that various dimensional changes relating to scale, component lengths, and surface areas of the pill crusher 200, may vary without departing from the spirit and scope of the present invention.

In an embodiment, the contoured first handle 216 may be fully extended by the spring coil 214 to allow for maximum separation between the first 202 and the second 204 reducing jaws, thereby permitting flexibility in the size, shape, and quantity of medical solids that can be placed between the eggcrate-patterned faces of the first 202 and the second 204 reducing jaws. The aforementioned eggcrate-patterned surface bumples may be varied in number and depth to facilitate a wider pill particle spread or a more efficient pulverizing action, without departing from the spirit and scope of the present invention. In all embodiments, when in the closed-jaw position, the individual bumples of the first 102 and second 104 reducing jaws are configured in such a manner that each bumple is precisely nested within the bumple groove of the opposing jaw, such that no air pockets remain between the jaws when they flushly meet. In this way, a medicine solid can be uniformly pulverized in response to one or more device 200 actuations.

FIG. 3 depicts a pill crushing device 300 being used to crush a medicine solid (not shown) that is contained within a durable plastic medicine sleeve 304 (See e.g., U.S. Pat. No. 7,637,449, Leyshon et al.), in accordance with an embodiment of the present invention. The pill crushing device 300 has both a downward and an upward force being simultaneously and respectively applied to the first handle 306 and the second 308, 310 handle by a person's hand 312 during a gripping/compression action. The person's hand 312 is shown actively engaging in a compressive force between the contoured first and second handles, 306 and 308. As a derivative of torque, the compressive force of the hand 312 is amplified and distributed, by compound-leveraged actuation, across the first 302 and second 304 reducing jaws, providing a substantial mechanical advantage during operation. A disposable pill retainer/sleeve 314 is illustrated protruding from the reducing jaws 302 and 304. The disposable pill retainer 314 may contain reduced medicine solid remains (e.g., a pill reduced to a powdered state), after one or more actuations generated by one or more compressions of the device 300. Generally, this optionally repetitive process would yield a fine, uncontaminated medical powder for use in subsequent medical caregiving applications. After a single use, the pill retainer 314 may be discarded so as not to contaminate further operations of the pill crushing device. These operations may be performed without restriction on the location of operation, as can be inferred from the scaled representation of an average person's hand 312 holding the pill crushing device 300, where the device's 300 compact size lends itself to mobile application, facilitating portability for a medical practitioner in performing various medication administration procedures. When situations arise requiring supplemental leverage for device 300 operation, the pill crushing device 300 may be placed on a flat, rigid surface, and the contoured second handle 308 and pill splitter component 310, collectively form a stable platform that allows for the pill crushing device 300 to securely stand upright for use with the application of a single downward force.

Figure 4:
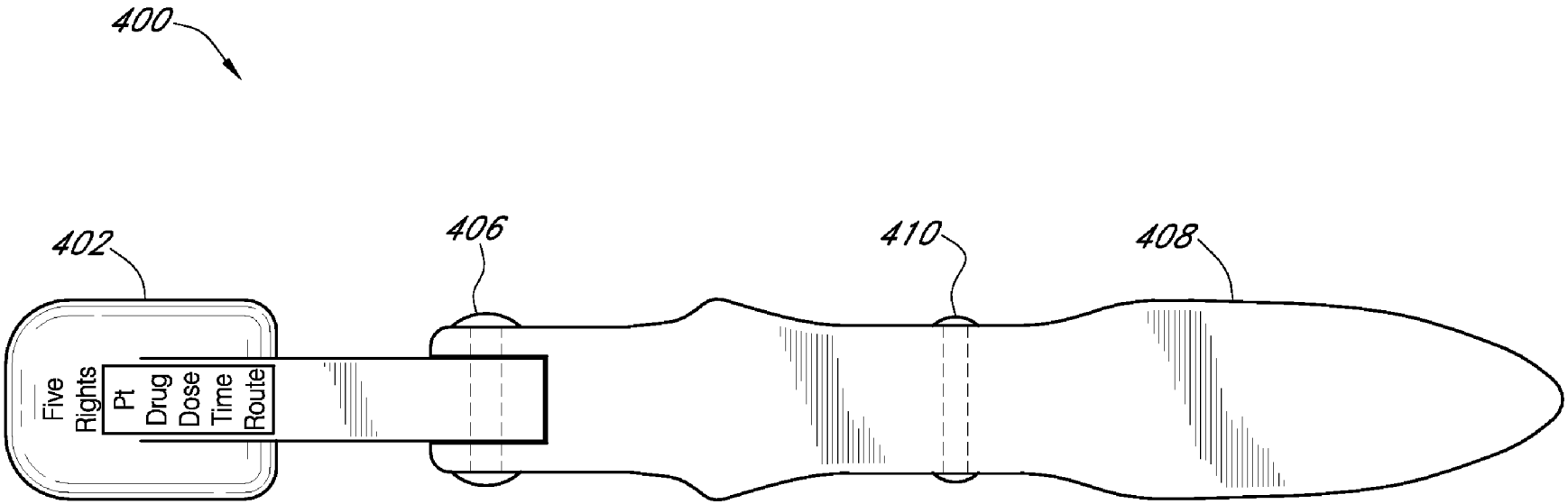
FIG. 4 illustrates a top plan view of the upper components of a pill crushing device, in accordance with an embodiment of the present invention.

FIG. 4 depicts a top-side view of the pill crusher device 400, showing the top of the first handle 408, the top of the first reducing jaw 402, as well as the upper compound pivot component 406 that pivotally connects the first reducing jaw 402 with the first handle 408, and the swing arm pivot point 410 that connects the swing arm locking component (not shown) to the first handle 408. In an embodiment, the top of the first reducing jaw 402 may be inscribed or affixed with words indicating the "five rights" of medication administration. These five rights are listed on the device 400 to increase safety and reduce the possibility of medication administration errors. As would be understood by those skilled in the Art, these five rights are listed to ensure that medications are accurately administered with respect to: 1) the Right Patient 2), the Right Drug, 3) the Right Dose, 4) the Right Time, and 5) the Right Route. By adhering to these guidelines, a registered nurse can ensure they have carried out their medication administration duties responsibly.

Figure 5:
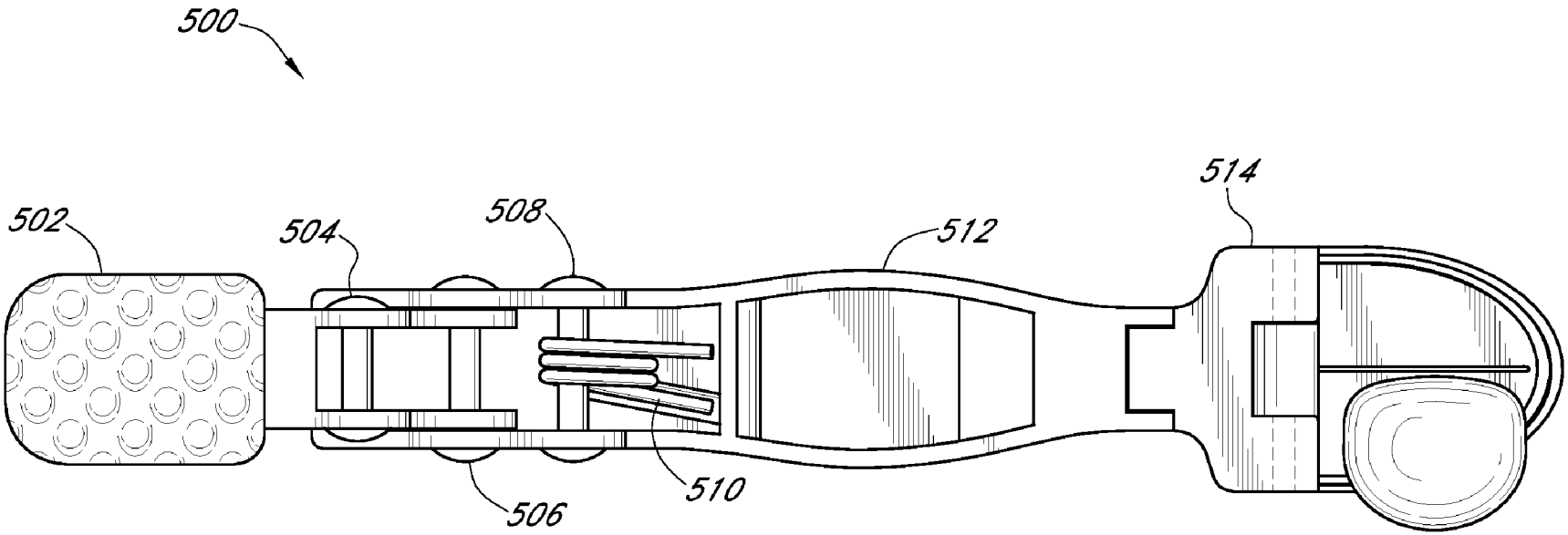
FIG. 5 illustrates a cross-sectional bottom view of the lower components of a pill crushing device, in accordance with an embodiment of the present invention.

FIG. 5 illustrates a cross-sectional view of the pill crusher 500, depicting the sectioned second handle 512, the second reducing jaw 502, and the lower portion 514 of the pill splitter component. Further depicted are the forward compound pivot component 504 that pivotally connects the first reducing jaw (not shown) with the second reducing jaw 502, the rearward compound pivot component 508 that pivotally connects the first handle (not shown) with the second handle 512 and acts as a support shaft for a coil spring component 510, and the lower compound pivot component 506 that pivotally connects the second reducing jaw 502 with the second handle 512. In an embodiment, the second handle 512 may be configured to comprise a groove for a lower arm of the coil spring component 510, such that the spring fits securely within the second handle 512. Similarly, in embodiment, the first handle 408 may be configured to comprise a groove (not shown) for an upper arm of the coil spring component 510, such that the spring fits securely within the first handle 408.

Figure 6B:
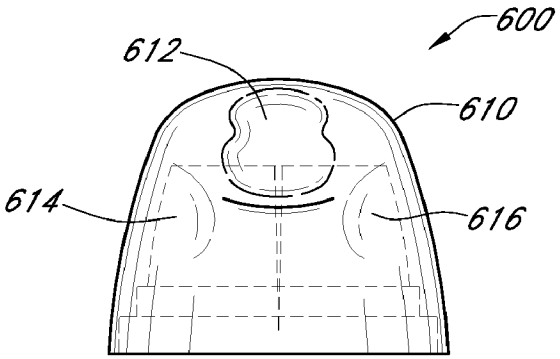
FIG. 6B illustrates a back plan view of an upper portion of a medicine solid splitting component, in accordance with an embodiment of the present invention.
Figure 6C:
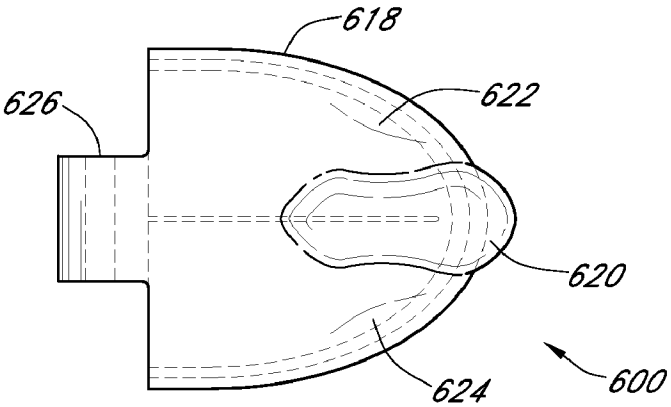
FIG. 6C illustrates a top plan view of an upper portion of a medicine solid splitting component, in accordance with an embodiment of the present invention.
Figure 6A:
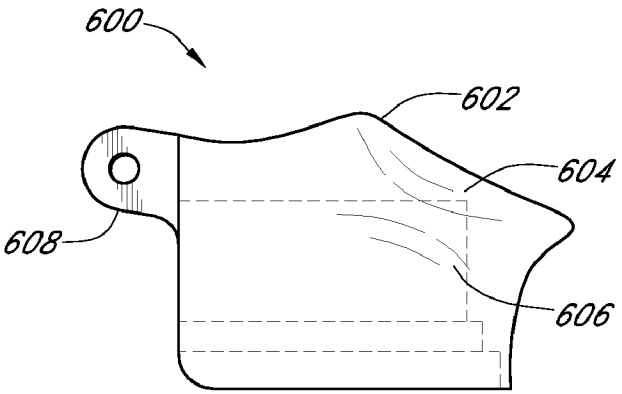
FIG. 6A illustrates a side plan view of an upper portion of a medicine solid splitting component, in accordance with an embodiment of the present invention.

FIG. 6A illustrates a side view 602 of the upper portion of a medicine solid splitting component 600, in accordance with an embodiment of the present invention. The upper portion of the medicine solid splitting component 600 may include a forward end 608 that allows the upper portion 600 to connect with the lower portion of the splitting component (not shown). The upper portion 600 may include a side recessed area 606 where a person's thumb or forefinger may be placed to grip and raise the upper portion of the splitting component 600 from the lower portion (See e.g., the open position of FIG. 7). The upper portion 600 may further include a top recessed area 606, where a person's thumb may be placed to apply a downward splitting force during a pill splitting process. In this actuation, the top of the pill splitter 600 (having an internal cutting blade) may partition a pill in a guillotine-like manner. FIG. 6B illustrates a back view 610 of an upper portion of a medicine solid splitting component 600, showing an alternate view of the upper component that depicts the left 614 and the right side 616 recessed areas and as well as the top recessed area 612, in accordance with an embodiment of the present invention. FIG. 6C illustrates a top view 618 of an upper portion of a medicine solid splitting component 600, showing an alternate view of the upper component, depicting left 622 and right side 624 recessed areas and as well as the top recessed area 620 and the forward end 626 that allows the upper portion 600 to connect with the rest of the pill crushing device (not shown) and the lower portion of the pill splitting component (not shown).

FIG. 7 illustrates a perspective view of a medicine solid splitting component 700 of a pill crushing device 702 in an open position having a medicine solid 720 (e.g., a pill) positioned therein, awaiting partitioning. In an embodiment, the pill splitting component 700 comprises an upper portion 704 that includes a pill splitting blade 706, which can act in as a guillotine blade in severing a pill into two parts of a preferred size/dose. In function, the upper portion is closed in response to a downward splitting force (e.g., a person applying their thumb to the top recessed area 620) to cause the first upper 704 to rotationally pivot about a splitter pivot component 710 that mechanically joins the upper 704 and lower 714 portions of the pill splitter component 700. The underside of the upper portion 704 may be ridged 708 to fit a grooved portion of the lower portion 714 of the splitter component, such that in a closed position, the first and lower portions are tightly fit together to prevent any portion of a split pill from exiting ("shooting out" from) the closed pill splitter 700, except through the receptacle trough 716. The trough 716 of the pill splitter is adapted to catch one or more split components of a pill 720 as the cutting blade 706 closes down on it, severing the pill 720 into two separate pieces, within the enclosed region of the splitter. In an embodiment, after the medicine solid 720 is split, the blade 706 may rest in a blade groove 718 at the bottom of the splitter while its rearward edge runs parallel with the back wall 712 of the pill splitter 700. In an embodiment the first portion of the splitting component 704 protects the splitting blade 706 from being exposed to accidental human contact. In operation of the pill splitter component 700, a partitioned section of the medicine solid 720 should drop down into the pill retaining trough 716, ready for subsequent pill crushing, storage, or any other alternative use.

While several embodiments of the present invention have been illustrated and described herein, many changes can be made without departing from the spirit and scope of the invention. Accordingly, the scope of the invention is not limited by any disclosed embodiment. Instead, the scope of the invention should be determined from the appended claims that follow.

The embodiments of the invention in which an exclusive property or privilege is claimed are defined as follows:

1. A portable tool for reducing medicine solids utilizing compound leveraged actuation, the portable tool comprising:

a first handle adapted to receive a downward force during actuation;

a second handle adapted to receive an upward force during actuation;

a first reducing jaw pivotally connected to the first handle;

a second reducing jaw pivotally connected to the second handle; and a plurality of pivot points facilitating compound leveraged actuation of the portable tool, wherein the first reducing jaw and the second reducing jaw are adapted to receive a medicine solid therebetween in an open-jaw position, and wherein, in response to a single applied force, a compound leveraged actuation simultaneously causes the first reducing jaw to pivot with the first handle and the second reducing jaw to pivot with the second handle, such that the medicine solid is reduced between the first and second reducing jaws as the portable tool achieves a closed-jaw position.

2. The portable tool of claim 1, wherein the first handle and the second handle are pivotally connected, and in response to the applied force, the leveraged actuation further causes a portion of the first handle to pivot with a portion of the second handle.

3. The portable tool of claim 1, wherein the first reducing jaw and the second reducing jaw are pivotally connected, and in response to the applied force, the leveraged actuation further causes a portion of the first reducing jaw to pivot with a portion of the second reducing jaw.

4. The portable tool of claim 1, wherein the second handle further comprises a medicine solid splitting mechanism configured at a distal end of the second handle.

5. The portable tool of claim 1, wherein the first handle further comprises a locking mechanism that allows the first handle to be locked to the second handle when the hand tool is in the closed-jaw position.

6. The portable tool of claim 1, wherein the second handle further comprises a stand portion that allows the portable tool to remain in an upright position utilizing the second handle as a base.

* * * * *